US009850851B2

(12) United States Patent
Kong et al.

(10) Patent No.: US 9,850,851 B2
(45) Date of Patent: Dec. 26, 2017

(54) CARBURETOR BASE OF ENGINE

(71) Applicant: Suzhou Cleva Precision Machinery & Technology Co., Ltd., Suzhou, Jingsu Province (CN)

(72) Inventors: Zhao Kong, Suzhou (CN); Ning Guo, Suzhou (CN); Keya Feng, Suzhou (CN)

(73) Assignee: Suzhou Cleva Precision Machinery & Technology Co., Ltd., Suzhou, Jiangsu Province (CN)

( * ) Notice: Subject to any disclaimer, the term of this patent is extended or adjusted under 35 U.S.C. 154(b) by 4 days.

(21) Appl. No.: 14/769,199

(22) PCT Filed: Jan. 20, 2014

(86) PCT No.: PCT/CN2014/070895

§ 371 (c)(1),
(2) Date: Aug. 20, 2015

(87) PCT Pub. No.: WO2014/131321

PCT Pub. Date: Sep. 4, 2014

(65) Prior Publication Data

US 2015/0377183 A1 Dec. 31, 2015

(30) Foreign Application Priority Data

Feb. 26, 2013 (CN) ..... 2013 1 0059284

(51) Int. Cl.
*F02M 35/10* (2006.01)
*F02M 17/34* (2006.01)
(Continued)

(52) U.S. Cl.
CPC ..... *F02M 17/34* (2013.01); *F02M 19/00* (2013.01); *F02M 35/10229* (2013.01);
(Continued)

(58) Field of Classification Search
CPC ..... F02D 9/02; F02D 2009/0201; F02D 2009/0205; F02D 2009/025;
(Continued)

(56) References Cited

U.S. PATENT DOCUMENTS 4,966,735 A * 10/1990 LoRusso ..... F02M 19/0235 261/40
6,260,536 B1 * 7/2001 Watanabe ..... F02B 63/02 123/184.46
(Continued)

FOREIGN PATENT DOCUMENTS

CN 101466941 6/2009
CN 201671727 12/2010
(Continued)

OTHER PUBLICATIONS

English Abstract for CN203130285U.
(Continued)

*Primary Examiner* — Hung Q Nguyen
*Assistant Examiner* — Anthony Taylor, Jr.
(74) *Attorney, Agent, or Firm* — JK Intellectual Property Law, PA

(57) ABSTRACT

A carburetor base of an engine defines an axial through hole and a pulsation hole channel. An anti-blocking component is mounted inside the axial through hole and defines an air inlet channel. The air inlet channel communicates with the pulsation hole channel so as to avoid blocking of condensed fuel oil inside the pulsation hole channel.

3 Claims, 3 Drawing Sheets

(51) Int. Cl.

| | |
|---|---|
| ***F02M 19/00*** | (2006.01) |
| ***F02M 37/04*** | (2006.01) |
| *F02M 37/14* | (2006.01) |
| *F02M 17/02* | (2006.01) |

(52) U.S. Cl.
CPC ..... *F02M 37/046* (2013.01); *F02M 17/02* (2013.01); *F02M 37/14* (2013.01)

(58) Field of Classification Search
CPC ..... F02D 2009/0262; F02D 2009/0272; F02D 2009/0291; F02D 2009/0296; F02D 2009/0298; F02M 19/00; F02M 19/02; F02M 19/06; F02M 19/088; F02M 35/10229; F02M 37/14; F02M 37/046; F02M 17/02; F02M 17/04; F02M 17/34
USPC ..... 123/184.21
See application file for complete search history.

(56) References Cited

U.S. PATENT DOCUMENTS 6,382,160 B2 * 5/2002 Husges ..... F02M 35/10078 123/184.46
6,536,747 B2 * 3/2003 Burns ..... F02M 3/12 261/35
2007/0152355 A1 * 7/2007 Hartley ..... B01F 5/0413 261/76

FOREIGN PATENT DOCUMENTS

| | | |
|---|---|---|
| CN | 130114943 | 5/2013 |
| CN | 203130285 U | 8/2013 |
| JP | 2011-74878 | 4/2011 |
| WO | WO 2009/119429 | 10/2009 |

OTHER PUBLICATIONS

English Abstract for CN130114943.
English Abstract for CN101466941.
English Abstract for WO2009/119429.
English Abstract for CN201671727.
English Abstract for JP2011-74878.
International Search Report dated Apr. 30, 2014 for PCT/CN2014/071895.

* cited by examiner

CARBURETOR BASE OF ENGINE

CROSS REFERENCE TO RELATED APPLICATIONS

This application claims benefit to Chinese application number 201310059284.7 filed Feb. 26, 2013, and claims priority to PCT International Application No. PCT/CN2014/070895 filed Jan. 20, 2014, both of which are incorporated herein.

TECHNICAL FIELD

The present invention relates to an engine, and more particularly, to a carburetor base of an engine.

BACKGROUND ART

At present, in hand-held mowers (shears) and backpack-type lawn and garden machines, conventional two-stroke and four-stroke small-size general-purpose engines have been widely used, requiring operating personnel to hold the device with the hands or bear on the back during operation.

An engine usually includes a cylinder, a carburetor disposed at one side of the cylinder, and a carburetor base disposed between the carburetor and the cylinder. An air inlet channel is disposed on the carburetor base, so that liquid oil enters the cylinder after being vapourized by the carburetor. Furthermore, a pulsation hole is also disposed on the carburetor, negative pressure generated due to reciprocating motion of a piston being transferred into the carburetor through the pulsation hole to drive the carburetor to run up. A pulsation hole channel is disposed on the carburetor base. The pulsation hole channel is connected between the air inlet channel on the carburetor base and the pulsation hole, so as to introduce a negative pressure power inside the air inlet channel into the pulsation hole. However, the existing pulsation hole channel is directly connected to the air inlet channel on the carburetor base; in this way, the oil and gas in the air inlet channel is very easily liquefied to thereby block the cooling of the engine, so that the carburetor cannot run up stably.

SUMMARY OF THE INVENTION

The object of the present invention is to provide an improved carburetor base of an engine directed to the foregoing defects in the related art, which can prevent blocking of condensed fuel oil inside a pulsation hole channel thereof.

To realize the foregoing objects, the present invention employs a major technical solution as follows. A carburetor base of an engine is provided with an axial through hole and a pulsation hole channel, wherein: the carburetor base is further provided with an anti-blocking component, the anti-blocking component is mounted in the axial through hole and is provided with an air inlet channel, and the air inlet channel is communicated with the pulsation hole channel.

Furthermore, the present invention also provides a technical solution attached as follows.

The anti-blocking component is provided with an annular recess on an outer wall thereof, and the annular recess is communicated with the pulsation hole channel.

The annular recess is provided with a through hole.

The through hole is located above the air inlet channel.

The engine is provided with a cylinder and a carburetor, and the carburetor base is disposed between the cylinder and the carburetor.

The carburetor base is provided with a first end portion and a second end portion opposite to the first end portion, the first end portion is matched with the cylinder, and the second end portion is matched with the carburetor.

The anti-blocking component is a tubular article, and is tightly matched with the axial through hole.

Compared with the prior art, the present invention has the advantages that: by mounting the anti-blocking component inside the axial through hole and is provided with the air inlet channel, and making the air inlet channel communicated with the pulsation hole channel, the blocking of the condensed fuel oil inside the pulsation hole channel is avoided.

DETAILED DESCRIPTION OF THE PREFERRED EMBODIMENTS

Further not-limiting description will made on the technical solution of the present invention in detail below with reference to the preferred embodiments and drawings.

Figure 1:
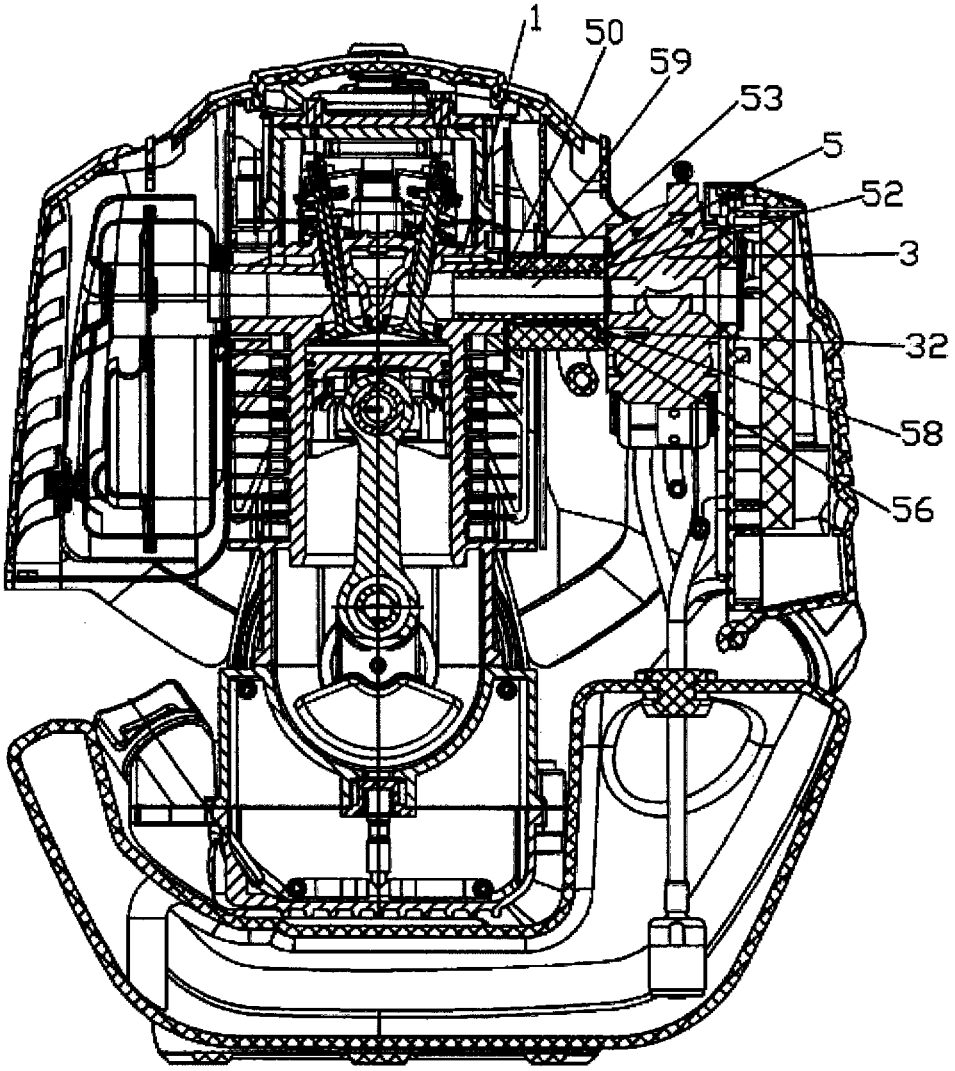
FIG. 1 is a cross-sectional view of an engine corresponding to a preferred embodiment of the present invention.

Referring to FIG. 1, an engine corresponding to the preferred embodiment of the present invention is a four-stroke petrol (gasoline) engine, which includes a cylinder 1, a carburetor 3 and a carburetor base 5 disposed between the cylinder 1 and the carburetor 3. The carburetor base 5 includes a first end portion 50 and a second end portion 52 opposite to the first end portion 50, wherein the first end portion 50 is matched with the cylinder 1, while the second end portion 52 is matched with the carburetor 3.

Figure 2:
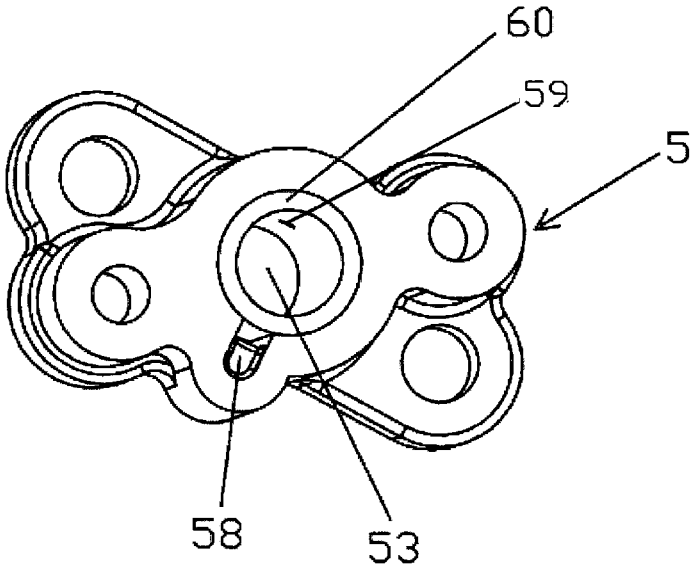
FIG. 2 is an isometric view of a carburetor base and anti-blocking component assembly of the engine in FIG. 1.
Figure 3:
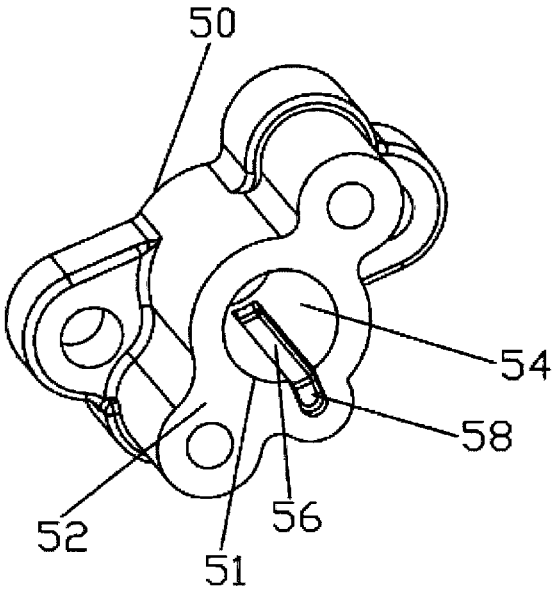
FIG. 3 is an isometric view of the carburetor base in FIG. 2.
Figure 4:
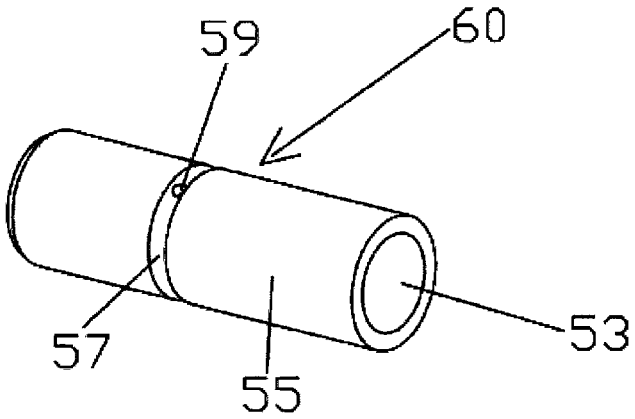
FIG. 4 is an isometric view of an anti-blocking component in FIG. 2

Further referring to FIG. 2 to FIG. 4, the foregoing carburetor base 5 is provided with an axial through hole 54, a pulsation hole channel 56 and an anti-blocking component 60. The pulsation hole channel 56 is disposed on the inner wall 51 of the axial through hole 54 and is provided with an anti-blocking gap 58. The anti-blocking gap 58 is communicated with the pulsation hole 32 of the carburetor 3.

The foregoing anti-blocking component 60 is mounted in the axial through hole 54 and is provided with an air inlet channel 53, and the air inlet channel 53 can be communicated with the pulsation hole channel 56. The anti-blocking component 60 is a tubular article, and is tightly matched with the axial through hole 54. The outer wall 55 of the anti-blocking component 60 is provided with an annular recess 57, and the annular recess 57 is provided with a through hole 59. When the anti-blocking component 60 is mounted in the axial through hole 54, the through hole 59 is located above the air inlet channel 53 (see FIGS. 1 and 2). The annular recess 57 realizes more convenient manufacturing and assembling; and meanwhile, the position of the through hole 59 can be adjusted according to different use situations of the machine during manufacturing, so that the through hole is located above the air inlet channel 53, and blocking of the through hole 59 is prevented.

In this way, the air inlet channel 53 communicates with the pulsation hole channel 56 through the foregoing through hole 59; moreover, by disposing the through hole 59 above the air inlet channel 53, the fuel oil vapourized by the carburetor 3 will smoothly pass through the air inlet channel 53 and then enter the cylinder 1, thus reducing and even avoiding the pulsation hole channel 56 or pulsation hole 32 from being blocked by the condensed fuel oil. The carburetor base 5 of the engine provided by the present invention has the advantages of novel structure and excellent running effect, and has excellent effects on the stable working of the engine.

It should be noted that the foregoing preferred embodiments are merely to explain the technical concepts and features of the present invention, intended to enable those familiar with this technology to understand the contents of the present invention and implement accordingly, but cannot limit the protection scope of the present invention for this account. Any equivalent change or modification made according to the spirit of the present invention shall all fall within the scope of the present invention.

The invention claimed is:

1. A carburetor base assembly for an engine having a cylinder and a carburetor, the carburetor base assembly comprising:

a carburetor base defining an axial through-hole having a surface and an axially extending pulsation hole channel defined in the surface; and an anti-blocking component, the anti-blocking component being a tubular member mounted in the axial through-hole and defining an air inlet channel therethrough, the tubular member defining an annular recess on an outer wall thereof, the annular recess communicating with the axially extending pulsation hole channel, a radial through-hole defined through the tubular member connecting the annular recess and the air inlet channel, the radial-through hole being located above the air inlet channel when the engine is held in an upright operating condition, whereby the air inlet channel communicates with the axially extending pulsation hole channel via the radial through-hole and the annular recess so that fuel oil vaporized by the carburetor passes through the air inlet channel and into the cylinder reducing the possibility of the pulsation hole channel being clogged by condensed fuel oil.

2. The carburetor base assembly for an engine according to claim 1, wherein the carburetor base is disposed between the cylinder and the carburetor.

3. The carburetor base assembly for an engine according to claim 2, wherein the carburetor base includes a first end portion and a second end portion opposite to the first end portion, the first end portion being matched with the cylinder, and the second end portion being matched with the carburetor.

* * * * *